US011084088B2

(12) United States Patent
Kajita et al.

(10) Patent No.: US 11,084,088 B2
(45) Date of Patent: Aug. 10, 2021

(54) CORE MANUFACTURING APPARATUS

(71) Applicant: TOYOTA JIDOSHA KABUSHIKI KAISHA, Toyota (JP)

(72) Inventors: Naoya Kajita, Toyota (JP); Junji Asano, Kariya (JP); Masahiro Umeda, Toyota (JP); Shota Nagashima, Toyota (JP); Masaomi Mitsutake, Nissin (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/026,524

(22) Filed: Sep. 21, 2020

(65) Prior Publication Data

US 2021/0187592 A1 Jun. 24, 2021

(30) Foreign Application Priority Data

Dec. 19, 2019 (JP) ..... JP2019-228939

(51) Int. Cl.

| | |
|---|---|
| ***B22C 5/14*** | (2006.01) |
| ***B22C 5/04*** | (2006.01) |
| ***B22C 9/10*** | (2006.01) |
| ***B22C 15/08*** | (2006.01) |

(52) U.S. Cl.

CPC ..... *B22C 5/14* (2013.01); *B22C 5/045* (2013.01); *B22C 9/10* (2013.01); *B22C 15/08* (2013.01)

(58) Field of Classification Search

CPC ..... B22C 14/045; B22C 9/10; B22C 15/00; B22C 15/02; B22C 15/06; B22C 15/08; B22C 13/00; B22C 13/12; B22C 13/16

See application file for complete search history.

(56) References Cited

U.S. PATENT DOCUMENTS

2013/0146619 A1 6/2013 Ozawa et al.

FOREIGN PATENT DOCUMENTS

| | | | |
|---|---|---|---|
| CN | 204524165 | U | 8/2015 |
| EP | 2 602 212 | A1 | 6/2013 |
| JP | 5-164599 | A | 6/1993 |
| JP | 7-109032 | A | 4/1995 |
| JP | 2015-101462 | A | 6/2015 |
| JP | 2017-131913 | A | 8/2017 |
| JP | 2019-202323 | A | 11/2019 |

*Primary Examiner* — Kevin P Kerns

*Assistant Examiner* — Steven S Ha

(74) *Attorney, Agent, or Firm* — Oblon, McClelland, Maier & Neustadt, L.L.P.

(57) ABSTRACT

A core manufacturing apparatus includes: a storage unit that stores core sand; a kneading vessel configured to be fed with the core sand; a kneading rod configured to knead the core sand; and a piston configured to eject the kneaded core sand. The kneading vessel is capable of transitioning between a horizontally lying state and a vertically standing state and configured to be fed with the core sand in the horizontally lying state. The piston is configured to eject the core sand downward and pack it into a mold with the kneading vessel in the vertically standing state. The storage unit includes a valve that opens and closes the feed port. The storage unit is coupled to the kneading vessel so as to be turnable around a second shaft and configured to maintain the same posture with the valve in contact with the feed port while the kneading vessel turns.

13 Claims, 4 Drawing Sheets

CORE MANUFACTURING APPARATUS

INCORPORATION BY REFERENCE

The disclosure of Japanese Patent Application No. 2019-228939 filed on Dec. 19, 2019 including the specification, drawings and abstract is incorporated herein by reference in its entirety.

BACKGROUND

1. Technical Field

The present disclosure relates to a core manufacturing apparatus.

2. Description of Related Art

There are known core manufacturing apparatuses that manufacture cores by kneading core sand along with a binder etc. in a kneading vessel and ejecting and packing the kneaded core sand (kneaded sand) into a mold. A core manufacturing apparatus developed by the present inventors kneads core sand with the kneading vessel in a horizontally lying state, as disclosed in Japanese Patent Application Publication No. 2017-131913 (JP 2017-131913 A). Since this core manufacturing apparatus ejects kneaded sand in a horizontal direction while the kneading vessel is in the horizontally lying state, it is difficult to pack the kneaded sand to the far corners of a mold.

Therefore, the present inventors developed another core manufacturing apparatus that kneads core sand with the kneading vessel in a horizontally lying state and then brings the kneading vessel into a vertically standing state to eject the kneaded sand downward and pack it into a mold, as disclosed in Japanese Patent Application Publication No. 2019-202323 (JP 2019-202323 A).

SUMMARY

In the core manufacturing apparatuses disclosed in JP 2017-131913 A and JP 2019-202323 A, a feed port through which core sand is fed is provided on the upper side of the kneading vessel in the horizontally lying state. Although this is not clearly shown in JP 2017-131913 A and JP 2019-202323 A, a storage unit (e.g., a hopper) that stores a predetermined amount of core sand to be fed into the kneading vessel is provided above the kneading vessel and coupled to the feed port. In addition, a valve that opens and closes the feed port is provided to prevent moisture inside the kneading vessel from entering a pipe extending from the feed port to the storage unit.

The core manufacturing apparatus disclosed in JP 2019-202323 A requires keeping the storage unit in the same posture, regardless of the posture of the kneading vessel, while the kneading vessel turns from the horizontally lying state to the vertically standing state. This makes it difficult to seal the feed port of the kneading vessel by the same valve both when the kneading vessel is in the horizontally lying state and when it is in the vertically standing state.

The present disclosure provides a core manufacturing apparatus in which the feed port of the kneading vessel can be sealed by the same valve both when the kneading vessel is in a horizontally lying state and when it is in a vertically standing state.

A core manufacturing apparatus as one aspect of the present disclosure includes: a storage unit configured to store core sand; a kneading vessel, which is tubular, configured to be fed with the core sand though a feed port to which the storage unit is coupled; a kneading rod provided inside the kneading vessel so as to extend in a longitudinal direction of the kneading vessel, and configured to knead the core sand by rotating around an axis parallel to the longitudinal direction; and a piston configured to eject the kneaded core sand from one end, in the longitudinal direction, of the kneading vessel. The kneading vessel is configured to be able to transition between a horizontally lying state and a vertically standing state by turning around a first shaft. The kneading vessel is configured to be fed with the core sand in the horizontally lying state through the feed port that is located on the upper side of the kneading vessel. The piston is configured to eject the core sand downward and pack the core sand into a mold with the kneading vessel in the vertically standing state. The storage unit includes a valve that opens and closes the feed port with the kneading vessel in the horizontally lying state by turning around a second shaft parallel to the first shaft while remaining in contact with the feed port. A part of the valve has an arc shape. The storage unit is coupled to the kneading vessel so as to be turnable around the second shaft, and is configured to maintain the same posture with the valve in contact with the feed port while the kneading vessel turns.

With the above aspect, the feed port can be sealed by the same valve both when the kneading vessel is in the horizontally lying state and when it is in the vertically standing state.

In the above aspect, the core manufacturing apparatus may include a parallel linkage having a driver that has the first shaft and the second shaft as joints. With the above configuration, the core manufacturing apparatus is excellent in maintainability.

In the above aspect, the valve may be made of a resin.

In the above aspect, the valve may be in contact with the feed port of which a circumferential edge is covered with a seal member having an annular shape and made of a resin. With the above configuration, the sealing of the gap between the valve and the feed port can be improved.

In the above aspect, the valve and the seal member may be made of different resins. With the above configuration, the adhesion between the valve and the feed port can be reduced.

In the above aspect, an annular groove extending along the circumferential edge of the feed port may be provided in the resin seal member, at a side facing an outer circumferential surface of the kneading vessel.

In the above aspect, a rubber packing may be provided between the seal member and an outer circumferential surface of the kneading vessel. With the above configuration, the sealing of the gap between the valve and the feed port can be further improved.

In the above aspect, the valve may have a cut-off spherical shape obtained by cutting off a portion of the valve that does not come into contact with the feed port. With the above configuration, the size and weight of the valve can be reduced.

In the above aspect, the valve may have a spherical shape.

In the above aspect, a through-hole perpendicular to the second shaft may be formed inside the valve.

In the above aspect, the storage unit may include a hopper that stores a predetermined amount of core sand to be fed into the kneading vessel, and a weigher configured to measure the weight of the hopper. The weigher may be configured to measure the weight of the core sand stored in the hopper while the core sand is supplied to the hopper.

With the above configuration, the core manufacturing apparatus is capable of simultaneously weighing and storing core sand and thereby achieves excellent productivity.

In the above aspect, the storage unit may include a preliminary tank that stores the core sand to be supplied to the hopper, and a valve provided on a pipe connecting the preliminary tank and the hopper to each other. When the core sand is supplied from the preliminary tank to the hopper, the degree of opening of the valve provided on the pipe may be adjusted based on the weight of the hopper measured by the weigher. With the above configuration, the core manufacturing apparatus can accurately control the weight of core sand to be fed into the weigh hopper.

In the above aspect, the valve configured to open and close the feed port may be made of an abrasion-resistant resin, and the seal member may be made of an abrasion-resistant resin.

With the above aspect, the present disclosure can provide a core manufacturing apparatus in which the feed port of the kneading vessel can be sealed by the same valve both when the kneading vessel is in the horizontally lying state and when it is in the vertically standing state.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

A specific embodiment to which the present disclosure is applied will be described in detail below with reference to the drawings. It is not intended that the present disclosure is limited to the following embodiment. To clarify the illustration, the following description and drawings are simplified as necessary.

Overall Configuration and Actions of Core Manufacturing Apparatus

Figure 1:
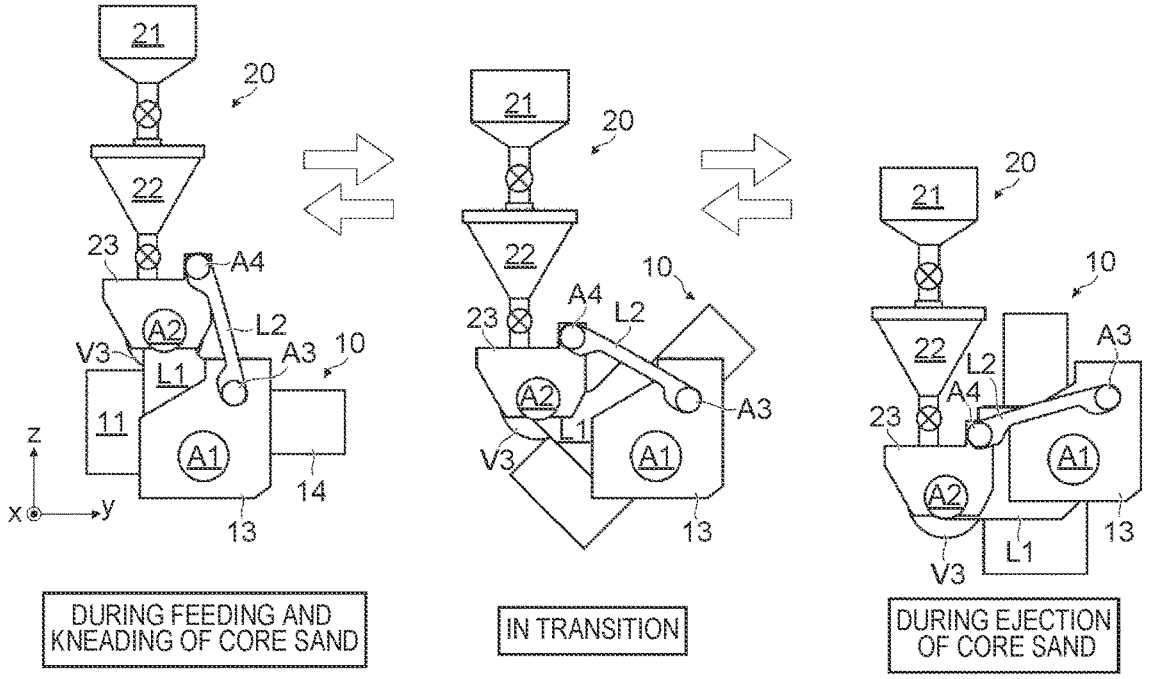
FIG. 1 is side views showing actions of a core manufacturing apparatus according to an embodiment.

First, the overall configuration and actions of a core manufacturing apparatus according to the embodiment will be described with reference to FIG. 1. FIG. 1 is side views showing the actions of the core manufacturing apparatus according to the embodiment. It should be understood that the right-handed xyz-orthogonal coordinate system shown in FIG. 1 and the other drawings is for the convenience of illustrating the positional relationship among components. Normally, a z-axis positive direction is a vertically upward direction and an xy-plane is a horizontal plane, which applies to all the drawings.

As shown in FIG. 1, the core manufacturing apparatus according to the embodiment includes a kneading unit 10, a storage unit 20, and links L1, L2. A brief overview of each component will be given here with reference to FIG. 1, and details thereof will be given later. The kneading unit 10 includes a kneading vessel 11 that is fed with core sand and kneads the core sand, a turning support member 13 that supports the kneading vessel 11, and a piston 14 that ejects the kneaded core sand. The storage unit 20 includes a preliminary tank 21 that temporarily stores core sand, a weigh hopper 22 that stores, while weighing, a predetermined amount of core sand to be fed into the kneading vessel 11, and a support member 23 that supports the preliminary tank 21 and the weigh hopper 22.

Here, the kneading vessel 11 is supported so as to be turnable around a shaft (first shaft) A1 by the turning support member 13 through the link L1 fixed on the kneading vessel 11. As shown in FIG. 1, the kneading vessel 11 is capable of transitioning between a horizontally lying state and a vertically standing state by turning 90° around the shaft A1. In the horizontally lying state shown on the left side in FIG. 1, core sand is fed from the weigh hopper 22 into the kneading vessel 11 and the fed core sand is kneaded. Then, in the vertically standing state shown on the right side in FIG. 1, the core sand is ejected downward (in a z-axis negative direction) and packed into a mold by the piston 14. Shown at the center in FIG. 1 is a state where the kneading vessel 11 is in transition from the horizontally lying state to the vertically standing state or from the vertically standing state to the horizontally lying state.

As will be described in detail later, the posture of the storage unit 20 depends on the support member 23. As shown in FIG. 1, the support member 23 is coupled to the link L1 so as to be turnable around a shaft (second shaft) A2. Since the link L1 is fixed on the kneading vessel 11, the support member 23 (i.e., the storage unit 20) is coupled to the kneading vessel 11 so as to be turnable around the shaft A2. The link L2 is coupled to the turning support member 13 so as to be turnable around a shaft A3 and coupled to the support member 23 so as to be turnable around a shaft A4.

Here, the turning support member 13, the support member 23, and the links L1, L2 constitute a parallel linkage having the four shafts A1 to A4 as joints. In the example of FIG. 1, the turning support member 13 is fixed on the ground and corresponds to a fixed link in the parallel linkage. The link L1 fixed on the kneading vessel 11 corresponds to a driver. The link L2 and the support member 23 correspond to a follower and a connector, respectively.

Thus configured, the core manufacturing apparatus according to the embodiment keeps the storage unit 20 coupled to the kneading vessel 11 in the same posture while the kneading vessel 11 turns. It is not necessary to uncouple the storage unit 20 from the kneading vessel 11 when the kneading vessel 11 turns. By thus eliminating the need for uncoupling and coupling actions, this apparatus achieves excellent core productivity.

As long as the requirement that the link L1 fixed on the kneading vessel 11 should constitute a driver is met, the support member 23 may constitute a fixed link and the turning support member 13 may constitute a connector. The storage unit 20 is required to be coupled to the kneading vessel 11 so as to be turnable around the shaft A2 parallel to the turning shaft A1 of the kneading vessel 11, and to remain coupled to the kneading vessel 11 in the same posture while the kneading vessel 11 turns. As long as this requirement is met, the storage unit 20 may be kept in the same posture by connecting the shafts A1, A2 to each other by a belt or a gear instead of the parallel linkage. However, compared with the means using a belt or a gear, a parallel linkage is less likely to fail when core sand sticks thereto and is excellent in maintainability.

Detailed Configuration of Core Manufacturing Apparatus

Figure 2:
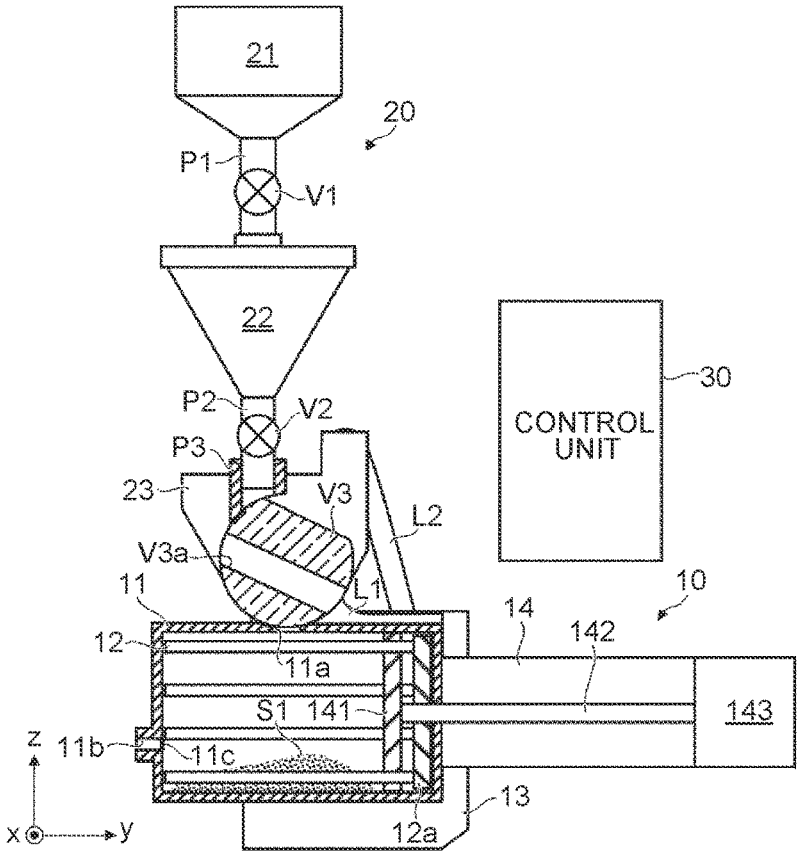
FIG. 2 is a sectional view of the core manufacturing apparatus according to the embodiment.
Figure 3:
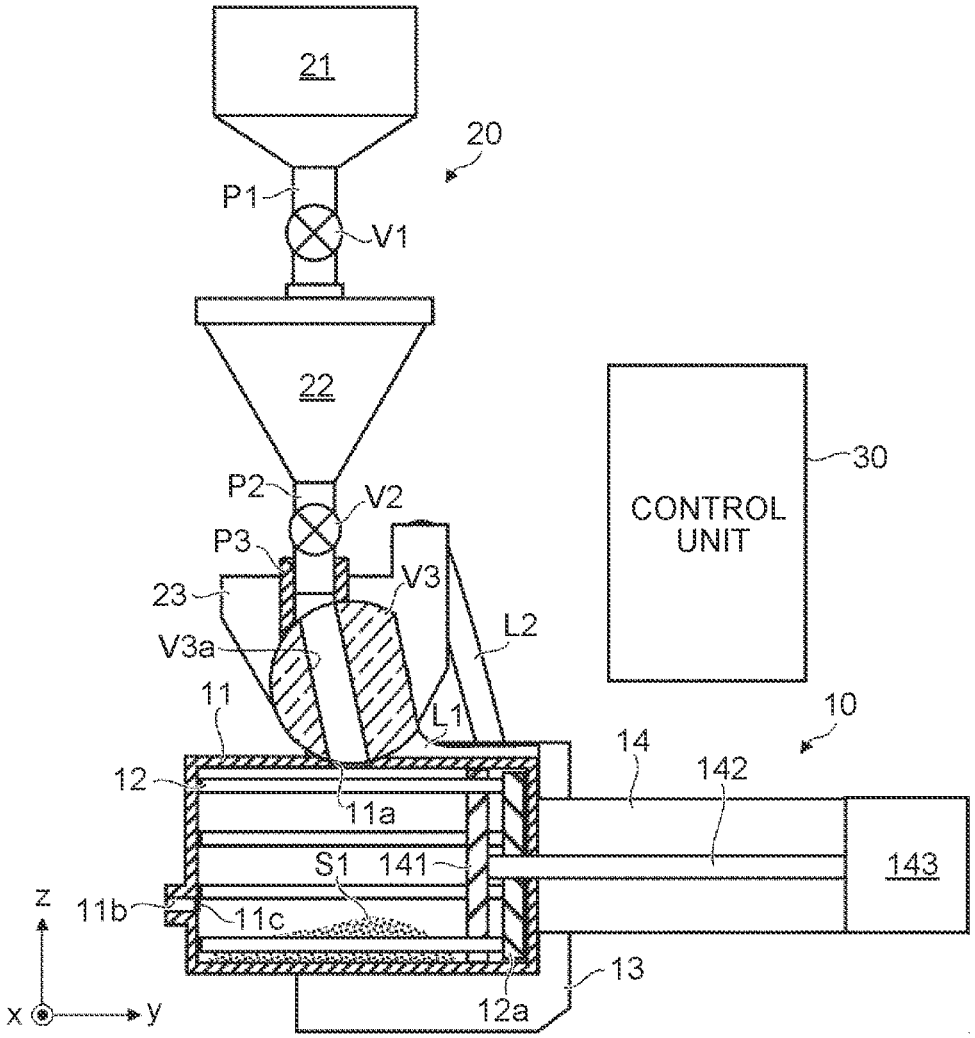
FIG. 3 is a sectional view of the core manufacturing apparatus according to the embodiment.
Figure 4:
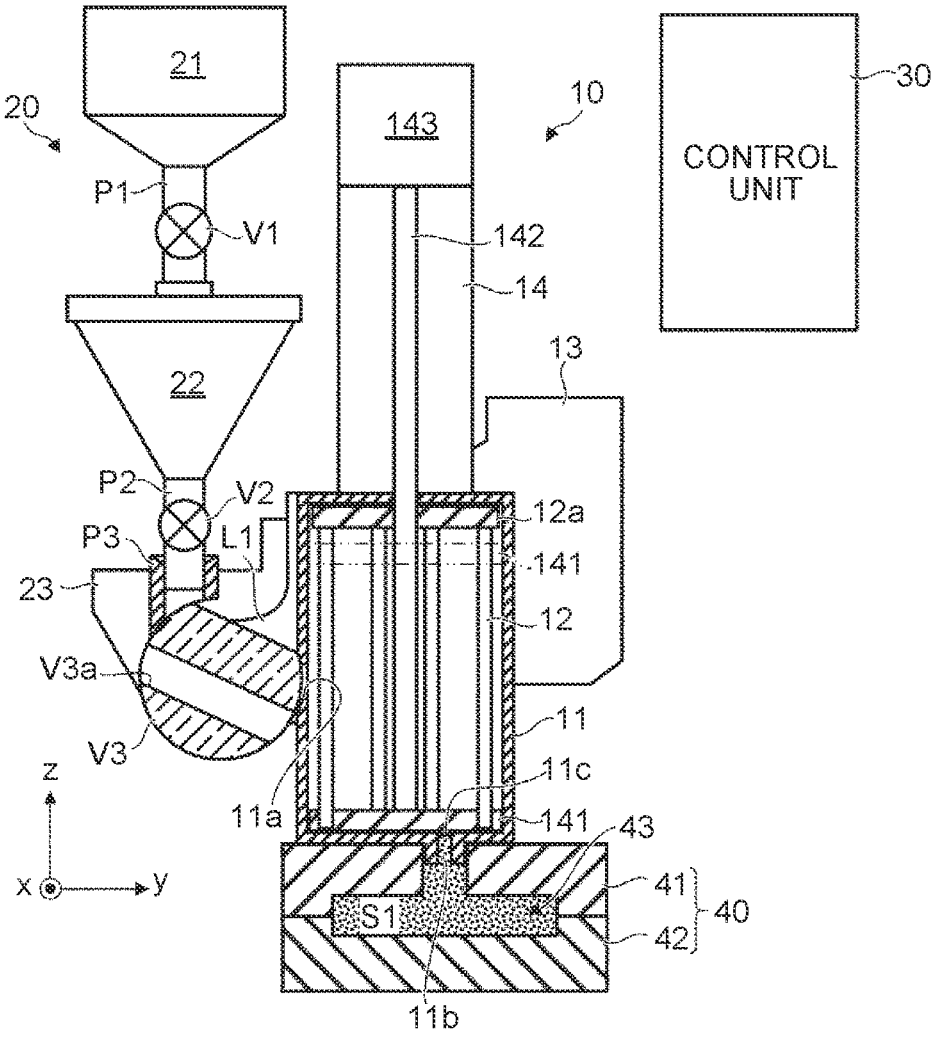
FIG. 4 is a sectional view of the core manufacturing apparatus according to the embodiment.

Next, each component of the core manufacturing apparatus according to the embodiment will be described in detail with reference to FIG. 1 to FIG. 4. FIG. 2 to FIG. 4 are sectional views of the core manufacturing apparatus according to the embodiment. FIG. 2 and FIG. 3 are sectional views showing states where the kneading vessel 11 is in the horizontally lying state shown on the left side in FIG. 1. FIG. 4 is a sectional view showing a state where the kneading vessel 11 is in the vertically standing state shown on the right side in FIG. 1. As shown in FIG. 2 to FIG. 4, the core manufacturing apparatus according to the embodiment includes the kneading unit 10, the storage unit 20, the links L1, L2, and a control unit 30.

Configuration of Kneading Unit 10

The configuration of the kneading unit 10 will be described. As shown in FIG. 2 to FIG. 4, the kneading unit 10 includes the kneading vessel 11, kneading rods 12, the turning support member 13, and the piston 14. The kneading vessel 11 is a tubular member that is fed with core sand S1 through a feed port 11*a* to which the storage unit 20 is coupled. The kneading vessel 11 has, for example, a cylindrical shape. As shown in FIG. 2 and FIG. 3, the feed port 11*a* is provided on an upper side of the kneading vessel 11 in the horizontally lying state of the kneading vessel 11. Thus, the core sand S1 can be fed into the kneading vessel 11 by gravity.

An ejection port 11*b* through which the kneaded core sand S1 is ejected is provided in one end surface, in a longitudinal direction, of the kneading vessel 11, and the piston 14 is provided on the other end surface. In the shown example, the ejection port 11*b* is provided so as to protrude from the end surface of the kneading vessel 11. When ejecting the core sand S1, a core forming mold (not shown) is coupled to the ejection port 11*b*.

The core sand S1 fed into the kneading vessel 11 is kneaded along with a binder. The core sand S1 may be either natural sand or artificial sand. The binder is, for example, an inorganic binder containing liquid glass and water, but may instead be an organic binder. The binder is sprayed from a spraying device (not shown) provided on an inner circumferential surface of the kneading vessel 11. The spraying device is provided, for example, in the vicinity of the feed port 11*a*.

The kneading rods 12 are provided inside the kneading vessel 11 so as to extend along substantially the entire length of the kneading vessel 11 in the longitudinal direction. There is a plurality of kneading rods 12, and these kneading rods 12 are fixed on, for example, a disc-shaped rotating base 12*a*. The rotating base 12*a* is provided inside the kneading vessel 11, at an end on the side of the piston 14, and rotates around an axis parallel to the longitudinal direction of the kneading vessel 11. Thus, the core sand S1 fed into the kneading vessel 11 is kneaded by the kneading rods 12.

The kneading rods 12 are disposed, for example, in a radial arrangement centered on a rotational axis. Alternatively, the kneading rods 12 may be disposed in an S-shape so as to be point-symmetrical with the rotational axis as the center. The shape of the kneading rods 12 is not particularly limited as long as it is a columnar shape extending parallel to the rotational axis. The cross-sectional shape of the kneading rods 12 is, for example, a circular shape, but may instead be an elliptical shape, a polygonal shape, etc.

Although this is not shown, the rotating base 12*a* is an external gear and driven to rotate by a driving source, such as a motor, through a gear disposed at a circumferential edge of the rotating base 12*a*. The operation of this driving source is controlled by, for example, the control unit 30. The rotational axis of the rotating base 12*a* coincides with a central axis of the cylindrical kneading vessel 11 in this embodiment, but the present disclosure is not particularly limited to this arrangement.

As described above and shown in FIG. 1, the kneading vessel 11 is supported so as to be turnable around the shaft (first shaft) A1 by the turning support member 13 through the link L1 fixed on the kneading vessel 11. As shown in FIG. 1, the kneading vessel 11 is capable of transitioning between the horizontally lying state and the vertically standing state by turning 90° around the shaft A1. The kneading vessel 11 is driven to rotate by a driving source (not shown), such as a motor, coupled to the shaft A1. The operation of this driving source is controlled by, for example, the control unit 30.

As shown in FIG. 2 and FIG. 3, with the kneading vessel 11 in the horizontally lying state, the core sand S1 is fed into the kneading vessel 11 through the feed port 11*a* located on the upper side of the kneading vessel 11, and the fed core sand S1 is kneaded by the kneading rods 12. When a valve V2 and a valve V3 to be described later are opened, the core sand S1 stored in the weigh hopper 22 is fed into the kneading vessel 11 by gravity. FIG. 2 shows a state where the valve V3 is closed, and FIG. 3 shows a state where the valve V3 is opened. To keep moisture inside the kneading vessel 11, the valves V2, V3 are closed except when the core sand S1 is fed.

As shown in FIG. 4, with the kneading vessel 11 in the vertically standing state, the core sand S1 is ejected downward (in the z-axis negative direction) and packed into a mold 40 by the piston 14. In the shown example, the mold 40 is composed of an upper mold 41 and a lower mold 42, with a cavity 43 formed therebetween. The core sand S1 ejected from the kneading vessel 11 by the piston 14 is packed into the cavity 43 to manufacture a core. This core is used, for example, to cast an on-board engine part.

The piston 14 shown in the drawings is an electrically operated ball-screw piston, and includes a piston head 141, a piston rod 142, and a motor 143. The piston head 141 is housed inside the kneading vessel 11 and disposed closer to the ejection port 11*b* than the rotating base 12*a* is. The piston head 141 is driven by the motor 143 that is coupled to the piston head 141 through the piston rod 142 that extends through the end surface of the kneading vessel 11. The operation of the motor 143 is controlled by, for example, the control unit 30.

Except during ejection, the piston head 141 is on standby at an end of the kneading vessel 11 on the side of the piston 14. During ejection, the piston head 141 advances in the longitudinal direction of the kneading vessel 11 and ejects the kneaded core sand S1 through the ejection port lib. As described above and shown in FIG. 4, the core sand S1 is ejected with the kneading vessel 11 in the vertically standing state. FIG. 4 shows a state where the piston head 141 has descended and the core sand S1 has been ejected.

A plug 11*c* made of rubber, for example, is mounted at a root of the ejection port 11*b*, i.e., on an inner end surface of the kneading vessel 11. The plug 11*c* can keep the core sand S1 fed into the kneading vessel 11 from leaking out of the kneading vessel 11. On the other hand, the plug 11*c* has an incision that has, for example, a cross shape as seen in a plan view and extends through a central portion of the plug 11*c* in a thickness direction thereof. Therefore, the plug 11*c* opens due to the incision when the core sand S1 inside the kneading vessel 11 is pressurized and ejected.

The gap between the inner circumferential surface of the kneading vessel 11 and an outer circumferential surface of the piston head 141 is kept sealed by a seal member or the like. The piston head 141 has through-holes into which the kneading rods 12 are fitted and inserted. The gap between an inner circumferential surface of each of these through-holes and an outer circumferential surface of the kneading rod 12 is also kept sealed by a seal member or the like. This configuration allows the core sand S1 inside the kneading vessel 11 to be ejected through the ejection port 11*b* without leaking. The piston head 141 can rotate along with the kneading rods 12. While the piston 14 is an electrically operated piston here, the piston 14 is not limited thereto and may instead be a piston driven by air pressure, oil pressure, or the like.

Configuration of Storage Unit 20

Next, the configuration of the storage unit 20 will be described. As shown in FIG. 2 to FIG. 4, the storage unit 20 includes the preliminary tank 21, the weigh hopper 22, the support member 23, pipes P1 to P3, and valves V1 to V3.

The preliminary tank 21 is a tank that temporarily stores the core sand S1 to be supplied to the weigh hopper 22. In the shown example, an upper part of the preliminary tank 21 has a cylindrical shape and a lower part thereof has an inverted conical shape. Although this is not shown, the core sand S1 is supplied to the preliminary tank 21 from a larger storage tank through a pipe etc. The preliminary tank 21 and the weigh hopper 22 are connected to each other by the pipe P1.

The weigh hopper 22 is provided under the preliminary tank 21, and a lower portion of the preliminary tank 21 and an upper portion of the weigh hopper 22 are connected to each other by the pipe P1. The pipe P1 is provided with the valve V1. When the valve V1 is opened, the core sand S1 stored in the preliminary tank 21 is fed into the weigh hopper 22 by gravity. The amount of core sand S1 to be fed can be finely adjusted by adjusting the degree of opening of the valve V1. As will be described later in detail, the degree of opening of the valve V1 is controlled by, for example, the control unit 30.

Figure 5:
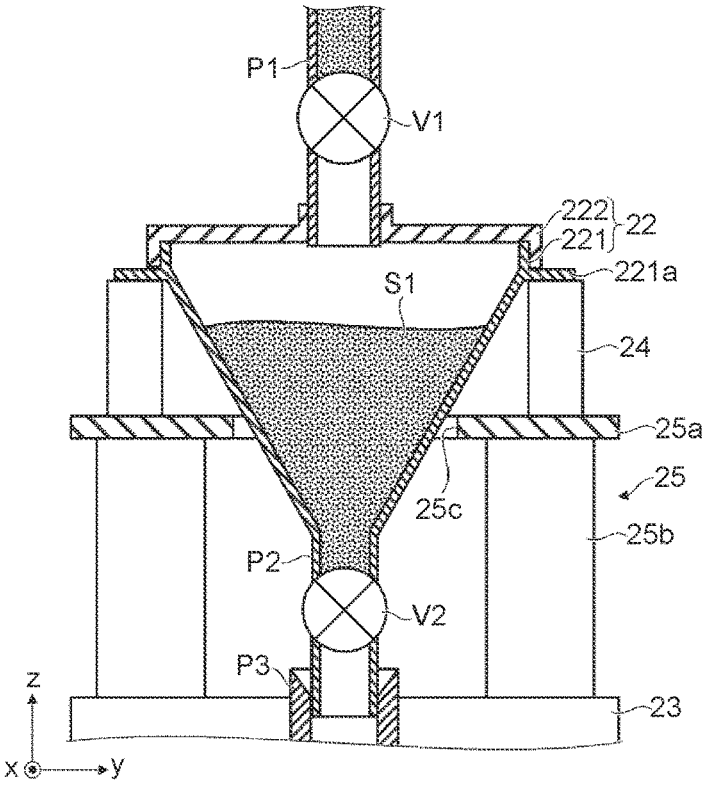
FIG. 5 is a detailed sectional view of a weigh hopper 22.

The weigh hopper 22 stores a predetermined amount of core sand S1 that has been weighed to be fed into the kneading vessel 11. Here, FIG. 5 is a detailed sectional view of the weigh hopper 22. As shown in FIG. 5, the storage unit 20 includes a weigher 24 that measures the weight of the weigh hopper 22, and a weigher support member 25 that supports the weigher 24. The core sand S1 stored in the weigh hopper 22 is weighed while the core sand S1 is supplied to the weigh hopper 22. Thus, the core manufacturing apparatus simultaneously weighs and stores core sand and thereby achieves excellent productivity.

The weigh hopper 22 includes a main body 221 and a lid 222. The main body 221 has an inverted conical shape, and includes a flange 221*a* that is provided on an outer circumferential surface at an upper portion of the main body 221 and protrudes outward. The lid 222 is a disc-shaped cover lid and fits on an upper end portion of the main body 221. A through-hole is provided at a central portion of the lid 222, and the pipe P1 is slidably fitted in the through-hole.

The pipe P2 extends from a lower end of the main body 221. A lower end portion of the pipe P2 is slidably fitted in the pipe P3. The pipe P2 is provided with the valve V2. When the valve V2 and the valve V3 to be described later are opened, the core sand S1 stored in the weigh hopper 22 is fed into the kneading vessel 11 by gravity. As described above, FIG. 3 shows the state where the valve V3 is opened. Opening and closing of the valve V2 and the valve V3 are controlled by, for example, the control unit 30.

The weigher 24 is, for example, a load cell and measures the weight of the weigh hopper 22. The flange 221*a* of the weigh hopper 22 is placed on the weigher 24. Specifically, the weigher 24 is loaded with the weights of the weigh hopper 22 (the main body 221 and the lid 222), the core sand S1 inside the weigh hopper 22, the pipe P2, and the valve V2.

Since the pipe P1 is slidably fitted in the through-hole of the lid 222 as described above, the weigher 24 is not loaded with the weights of members located above the pipe P1. Since the pipe P2 is slidably fitted in the pipe P3, the weigher 24 is not loaded with the weights of members located under the pipe P3.

The weight of the core sand S1 fed from the preliminary tank 21 into the weigh hopper 22 can be learned from the weight measured by the weigher 24. For example, based on the weight measured by the weigher 24, the control unit 30 controls the degree of opening of the valve V1 such that the weight of the core sand S1 inside the weigh hopper 22 meets a target value. For example, the control unit 30 decreases the degree of opening of the valve V1 as the weight of the core sand S1 approaches the target value. Under this control, the weight of the core sand S1 to be fed into the weigh hopper 22 can be accurately controlled.

As shown in FIG. 5, the weigher support member 25 includes a flat-plate-shaped platform 25*a* and pillars 25*b* that support the platform 25*a*. The weigher 24 is placed and fixed on the platform 25*a*. The pillars 25*b* are fixed on the support member 23. Therefore, the weigher 24 is supported by the support member 23 through the weigher support member 25.

A through-hole 25*c* through which the main body 221 of the weigh hopper 22 is inserted is provided at a central portion of the platform 25*a*. Thus, the weigher support member 25 supports only the weigher 24 and does not directly support the weigh hopper 22. With this configuration, the weigher 24 is able to measure the weight of the weigh hopper 22.

On the other hand, the weigher 24 supports the weigh hopper 22 while measuring the weight of the weigh hopper 22. Therefore, the weigher support member 25 supports the weigh hopper 22 through the weigher 24. The support member 23 supports the weigh hopper 22 through the weigher support member 25 and the weigher 24.

Thus, the support member 23 indirectly supports the weigh hopper 22. Similarly, the support member 23 indirectly supports the preliminary tank 21 through a support member (not shown). This is why the posture of the storage unit 20 depends on the support member 23.

Here, as shown in FIG. 1, the support member 23 is coupled to the link L1 so as to be turnable around the shaft (second shaft) A2. Since the link L1 is fixed on the kneading vessel 11, the support member 23 is coupled to the kneading vessel 11 so as to be turnable around the shaft A2. The support member 23 is coupled to the link L2 so as to be turnable around the shaft A4. The link L2 is coupled to the turning support member 13 so as to be turnable around the shaft A3.

As described above and shown in FIG. 1, the turning support member 13, the support member 23, and the links L1, L2 constitute a parallel linkage having the four shafts A1 to A4 as joints. In the example of FIG. 1, the turning support member 13 is fixed on the ground and corresponds to a fixed link in the parallel linkage. The link L1 fixed on the kneading vessel 11 corresponds to a driver. The link L2 and the support member 23 correspond to a follower and a connector, respectively.

Thus configured, the core manufacturing apparatus according to the embodiment keeps the storage unit 20 coupled to the kneading vessel 11 in the same posture while the kneading vessel 11 turns. It is not necessary to uncouple the storage unit 20 from the kneading vessel 11 when the kneading vessel 11 turns. By thus eliminating the need for uncoupling and coupling actions, this apparatus achieves excellent core productivity.

Referring back to FIG. 2 to FIG. 4, the description continues. The pipe P3 is fixed on the support member 23. The pipe P2 is fitted at one end of the pipe P3 as described above, and the valve V3 is disposed at the other end of the pipe P3. The shape of the other end of the pipe P3 is adapted to the surface shape of the valve V3 so as to keep the core sand S1 from leaking.

The valve V3 is supported by the support member 23 shown in FIG. 1 so as to be turnable around the turning shaft A2 of the support member 23. Thus, the valve V3 can turn around the shaft A2 relatively to the support member 23, and can also turn around the shaft A2 along with the support member 23 relatively to the kneading vessel 11. As shown in FIG. 2 and FIG. 3, the valve V3 opens and closes the feed port 11*a* with the kneading vessel 11 in the horizontally lying state by turning around the shaft A2 relatively to the support member 23 while remaining in contact with the feed port 11*a*.

As shown in FIG. 2 and FIG. 4, the support member 23 (i.e., the storage unit 20) can maintain the same posture with the valve V3 in contact with the feed port 11*a* while the kneading vessel 11 turns. Thus, the feed port 11*a* can be sealed by the same valve V3 both when the kneading vessel 11 is in the horizontally lying state and when the kneading vessel 11 is in the vertically standing state. The turning actions (i.e., opening and closing) of the valve V3 relatively to the support member 23 are controlled by, for example, the control unit 30.

The valve V3 shown in FIG. 2 to FIG. 4 has a cut-off spherical shape obtained by cutting off, by a plane, a portion of the valve V3 that does not come into contact with the feed port 11*a*, but may instead have a shape of a perfect sphere. This cut-off spherical shape can reduce the size and weight of the valve V3. Since a part of the valve V3 has an arc shape, the feed port 11*a* has a substantially circular shape. The valve V3 is made of a resin, for example, but may instead be made of a metal etc. For example, the valve V3 is made of an abrasion-resistant resin, such as fluorine resin, super-high-molecular polyethylene, polyacetal, or polyamide.

Figure 6:
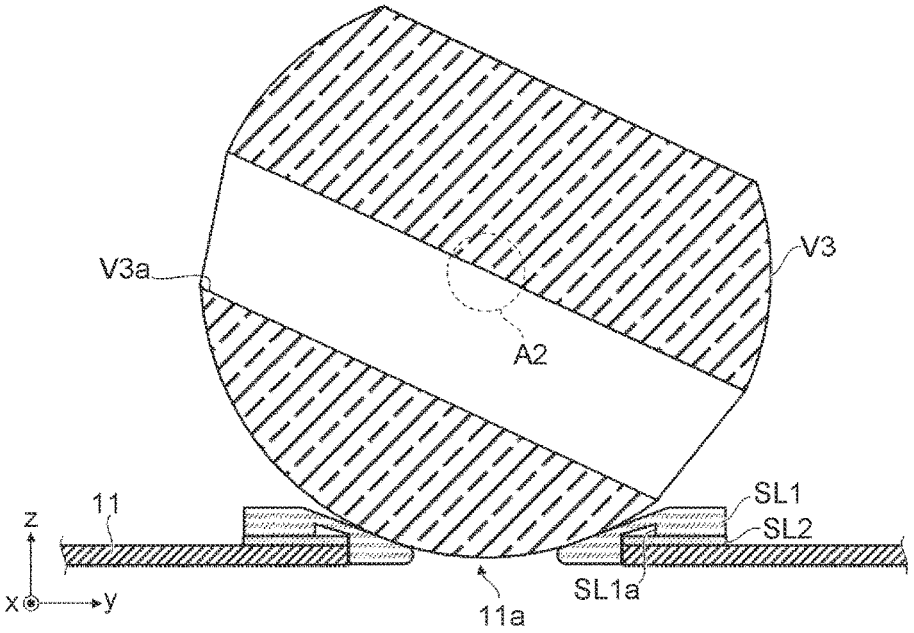
FIG. 6 is a detailed sectional view of a valve V3 and a feed port 11*a*.

Here, FIG. 6 is a detailed sectional view of the valve V3 and the feed port 11*a*. FIG. 6 corresponds to an enlarged view of FIG. 2. As shown in FIG. 6, the valve V3 is in contact with the feed port 11*a* of which a circumferential edge is covered with a seal member SL1, which has an annular shape and made of a resin. With this configuration, the sealing of the gap between the valve V3 and the feed port 11*a* is kept. Like the valve V3, the resin seal member SL1 is made of an abrasion-resistant resin, such as fluorine resin, super-high-molecular polyethylene, polyacetal, or polyamide. To reduce adhesion between the valve V3 and the resin seal member SL1, for example, the valve V3 and the resin seal member SL1 may be made of different resins. For example, the valve V3 may be made of fluorine resin and the resin seal member SL1 may be made of super-high-molecular polyethylene.

In the example of FIG. 6, the resin seal member SL1 is provided so as to protrude from the circumferential edge of the feed port 11*a* toward a center side. A portion of the resin seal member SL1 that protrudes toward the center side of the feed port 11*a* has a triangular cross-sectional shape, with the thickness decreasing gradually toward the center of the feed port Ha. This allows the resin seal member SL1 to come into close contact with the valve V3 easily.

In the example of FIG. 6, an annular groove SL1*a* extending along the circumferential edge of the feed port 11*a* is provided in the resin seal member SL1, at a side facing the outer circumferential surface of the kneading vessel 11. Since the thickness of the resin seal member SL1 decreases gradually toward the center of the feed port 11*a* as described above, the groove SL1*a* also has a triangular cross-sectional shape. A portion of the resin seal member SL1 where the groove SL1*a* is formed has a substantially constant small thickness and deforms easily. Therefore, the resin seal member SL1 can come easily into close contact with the valve V3 and also easily absorb thermal expansion of the valve V3. Thus, providing the groove SL1*a* contributes to sealing the gap between the valve V3 and the feed port 11*a* more effectively.

Further, in the example of FIG. 6, a flat-plate-shaped annular rubber packing SL2 is provided between the resin seal member SL1 and the outer circumferential surface of the kneading vessel 11. Providing the rubber packing SL2 allows the resin seal member SL1 to come into close contact with the valve V3 more easily and also to absorb thermal expansion of the valve V3. Thus, providing the rubber packing SL2 contributes to sealing the gap between the valve V3 and the feed port 11*a* even more effectively. The rubber packing SL2 is made of, for example, silicone rubber.

As shown in FIG. 6, a through-hole V3*a* perpendicular to the turning shaft A2 of the valve V3 is formed inside the valve V3. In the state shown in FIG. 2 (FIG. 6), the valve V3 is closed and the feed port 11*a* of the kneading vessel 11 is closed with the valve V3. On the other hand, in the state shown in FIG. 3, the valve V3 has opened by turning around the shaft A2 from the state shown in FIG. 2. In this state, the pipe P3 and the feed port 11*a* of the kneading vessel 11 are connected to each other through the through-hole V3*a* inside the valve V3, so that the core sand S1 can be fed into the kneading vessel 11. Except when the core sand S1 is fed, the valve V3 is closed to thereby keep moisture inside the kneading vessel 11 from entering the pipe P3.

The control unit 30 shown in FIG. 2 to FIG. 4 controls all actions in the core manufacturing apparatus, including the turning actions of the kneading vessel 11, the rotating actions of the kneading rods 12, the actions of the piston 14, the opening and closing actions of the valves V1 to V3, and adjustment of the degrees of opening of the valves. The control unit 30 may be divided into a plurality of units and provided as such. Although this is not shown, the control unit 30 functions as a computer and includes, for example, a computing part, such as a central processing unit (CPU), and a storing part, such as a random-access memory (RAM) or a read-only memory (ROM), that stores various control programs, data, etc.

As has been described above, in the core manufacturing apparatus according to the embodiment, the storage unit 20 is coupled to the kneading vessel 11 so as to be turnable around the shaft A2, and the storage unit 20 remains coupled to the kneading vessel 11 in the same posture while the kneading vessel 11 turns. It is not necessary to uncouple the storage unit 20 from the kneading vessel 11 when the kneading vessel 11 turns. By thus eliminating the need for uncoupling and coupling actions, this apparatus achieves excellent core productivity.

In the core manufacturing apparatus according to the embodiment, the storage unit 20 includes the valve V3 having a spherical shape or a cut-off spherical shape that opens and closes the feed port 11*a* with the kneading vessel 11 in the horizontally lying state by turning around the shaft A2 while remaining in contact with the feed port 11*a*. Therefore, as shown in FIG. 2 and FIG. 4, the storage unit 20 can maintain the same posture with the valve V3 in contact with the feed port 11*a* while the kneading vessel 11 turns. Thus, the feed port 11*a* can be sealed by the same valve V3 both when the kneading vessel 11 is in the horizontally lying state and when the kneading vessel 11 is in the vertically standing state.

The present disclosure is not limited to the above embodiment but can be changed as necessary within the scope of the gist of the disclosure.

What is claimed is:

1. A core manufacturing apparatus comprising:

a storage unit configured to store core sand;

a kneading vessel, which is tubular, configured to be fed with the core sand though a feed port to which the storage unit is coupled;

a kneading rod provided inside the kneading vessel so as to extend in a longitudinal direction of the kneading vessel, and configured to knead the core sand by rotating around an axis parallel to the longitudinal direction; and a piston configured to eject the kneaded core sand from one end, in the longitudinal direction, of the kneading vessel, wherein:

the kneading vessel is configured to be able to transition between a horizontally lying state and a vertically standing state by turning around a first shaft;

the kneading vessel is configured to be fed with the core sand in the horizontally lying state through the feed port that is located on an upper side of the kneading vessel;

the piston is configured to eject the core sand downward and pack the core sand into a mold with the kneading vessel in the vertically standing state;

the storage unit includes a valve configured to open and close the feed port with the kneading vessel in the horizontally lying state by turning around a second shaft parallel to the first shaft while remaining in contact with the feed port;

a part of the valve has an arc shape; and the storage unit is coupled to the kneading vessel so as to be turnable around the second shaft, and is configured to maintain the same posture with the valve in contact with the feed port while the kneading vessel turns.

2. The core manufacturing apparatus according to claim 1, further comprising a parallel linkage having a driver that has the first shaft and the second shaft as joints.

3. The core manufacturing apparatus according to claim 1, wherein the valve is made of a resin.

4. The core manufacturing apparatus according to claim 1, wherein the valve is in contact with the feed port of which a circumferential edge is covered with a seal member having an annular shape and made of a resin.

5. The core manufacturing apparatus according to claim 4, wherein the valve and the seal member are made of different resins.

6. The core manufacturing apparatus according to claim 4, wherein an annular groove extending along the circumferential edge of the feed port is provided in the seal member, at a side facing an outer circumferential surface of the kneading vessel.

7. The core manufacturing apparatus according to claim 4, wherein a rubber packing is provided between the seal member and an outer circumferential surface of the kneading vessel.

8. The core manufacturing apparatus according to claim 4, wherein the valve configured to open and close the feed port is made of an abrasion-resistant resin, and the seal member is made of an abrasion-resistant resin.

9. The core manufacturing apparatus according to claim 1, wherein the valve has a cut-off spherical shape obtained by cutting off a portion of the valve that does not come into contact with the feed port.

10. The core manufacturing apparatus according to claim 1, wherein the valve has a spherical shape.

11. The core manufacturing apparatus according to claim 1, wherein a through-hole perpendicular to the second shaft is formed inside the valve.

12. The core manufacturing apparatus according to claim 1, wherein:

the storage unit includes a hopper that stores a predetermined amount of core sand to be fed into the kneading vessel, and a weigher configured to measure a weight of the hopper; and the weigher is configured to measure a weight of the core sand stored in the hopper while the core sand is supplied to the hopper.

13. The core manufacturing apparatus according to claim 12, wherein:

the storage unit includes a preliminary tank that stores the core sand to be supplied to the hopper, and a valve provided on a pipe connecting the preliminary tank and the hopper to each other; and when the core sand is supplied from the preliminary tank to the hopper, a degree of opening of the valve provided on the pipe is adjusted based on the weight of the hopper measured by the weigher.

* * * * *